US009609894B2

(12) United States Patent
Abramov et al.

(10) Patent No.: US 9,609,894 B2
(45) **Date of Patent: *Apr. 4, 2017**

(54) HEATING SMOKABLE MATERIAL

(75) Inventors: Oleg J. Abramov, St. Petersburg (RU); Petr Alexandrovich Egoyants, St. Petersburg (RU); Dmitry Mikhailovich Volobuev, St. Petersburg (RU); Pavel Nikolaevich Fimin, St. Petersburg (RU)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/343,368

(22) PCT Filed: Aug. 24, 2012

(86) PCT No.: PCT/EP2012/066525

§ 371 (c)(1),
(2), (4) Date: Jun. 24, 2014

(87) PCT Pub. No.: WO2013/034460

PCT Pub. Date: Mar. 14, 2013

(65) Prior Publication Data

US 2014/0338680 A1 Nov. 20, 2014

(30) Foreign Application Priority Data

Sep. 6, 2011 (RU) ..... 2011136869
Apr. 23, 2012 (GB) ..... 1207054.6
Jun. 15, 2012 (RU) ..... 2012124800

(51) Int. Cl.
*A24F 47/00* (2006.01)

(52) U.S. Cl.
CPC ..... *A24F 47/008* (2013.01)

(58) Field of Classification Search
CPC .... A24F 47/002; A24F 47/004; A24F 27/006; A24F 27/008
See application file for complete search history.

(56) References Cited

U.S. PATENT DOCUMENTS 1,886,391 A 11/1932 Gauvin
2,104,266 A 1/1938 McCormick
(Continued)

FOREIGN PATENT DOCUMENTS

CN 86102917 11/1987
CN 1040914 4/1990
(Continued)

OTHER PUBLICATIONS

International Search Report and Written Opinion, mailed Jan. 9, 2013 for PCT/EP2012/066525 filed Aug. 24, 2012.
(Continued)

*Primary Examiner* — Anthony Calandra
(74) *Attorney, Agent, or Firm* — Patterson Thuente Pedersen, P.A.

(57) ABSTRACT

An apparatus comprising a smokable material heater, configured to heat a first region of smokable material to a volatizing temperature sufficient to volatize a component of smokable material and to concurrently heat a second region of smokable material to a temperature lower than said volatizing temperature but which is sufficient to prevent condensation of volatized components of the smokable material. A method of heating smokable material is also described.

15 Claims, 10 Drawing Sheets

(56) References Cited

U.S. PATENT DOCUMENTS

| | | | | |
|---|---|---|---|---|
| 3,804,100 | A | 4/1974 | Fariello | |
| 3,805,806 | A | 4/1974 | Grihalva | |
| 3,889,690 | A | 6/1975 | Guarnieri | |
| 4,171,000 | A | 10/1979 | Uhle | |
| 4,303,083 | A | 12/1981 | Burruss, Jr. | |
| 4,474,191 | A | 10/1984 | Steiner | |
| 4,588,976 | A | 5/1986 | Jaselli | |
| 4,638,820 | A | 1/1987 | Roberts et al. | |
| 4,735,217 | A | 4/1988 | Gerth et al. | |
| 4,756,318 | A | 7/1988 | Clearman et al. | |
| 4,765,347 | A | 8/1988 | Sensabaugh et al. | |
| 4,907,606 | A | 3/1990 | Lilja et al. | |
| 4,922,901 | A | 5/1990 | Brooks et al. | |
| 4,945,929 | A | 8/1990 | Egilmex | |
| 4,945,931 | A | 8/1990 | Gori | |
| 4,947,874 | A | 8/1990 | Brooks et al. | |
| 4,947,875 | A | 8/1990 | Brooks et al. | |
| 5,040,551 | A | 8/1991 | Schlatter et al. | |
| 5,060,671 | A | 10/1991 | Counts et al. | |
| 5,093,894 | A | 3/1992 | Deevi | |
| 5,095,921 | A | 3/1992 | Losee et al. | |
| 5,179,966 | A | 1/1993 | Losee et al. | |
| 5,190,060 | A | 3/1993 | Gerding et al. | |
| 5,224,498 | A | 7/1993 | Deevi et al. | |
| 5,249,586 | A | 10/1993 | Morgan et al. | |
| 5,269,327 | A | 12/1993 | Counts et al. | |
| 5,285,798 | A | 2/1994 | Banerjee et al. | |
| 5,303,720 | A | 4/1994 | Banerjee et al. | |
| 5,322,075 | A | 6/1994 | Deevi et al. | |
| 5,327,915 | A | 7/1994 | Porenski et al. | |
| 5,331,979 | A | 7/1994 | Henley | |
| 5,345,951 | A | 9/1994 | Serrano et al. | |
| 5,369,723 | A | 11/1994 | Counts et al. | |
| 5,388,594 | A | 2/1995 | Counts et al. | |
| 5,402,803 | A | 4/1995 | Takagi | |
| 5,408,574 | A | 4/1995 | Deevi et al. | |
| 5,573,140 | A | 11/1996 | Satomi et al. | |
| 5,613,504 | A | 3/1997 | Collins et al. | |
| 5,613,505 | A | 3/1997 | Campbell et al. | |
| 5,665,262 | A | 9/1997 | Hajaligol et al. | |
| 5,771,845 | A | 6/1998 | Pistien et al. | |
| 5,865,186 | A | 2/1999 | Volsey, II | |
| 6,089,857 | A | 7/2000 | Matsuura et al. | |
| 6,155,268 | A | 12/2000 | Takeuchi | |
| 7,374,063 | B2 | 5/2008 | Reid | |
| 7,624,739 | B2 | 12/2009 | Snaidr et al. | |
| 7,913,688 | B2 | 3/2011 | Cross et al. | |
| 8,061,361 | B2 | 11/2011 | Maeder et al. | |
| 8,079,371 | B2 | 12/2011 | Robinson et al. | |
| 8,081,474 | B1 | 12/2011 | Zohni | |
| 8,678,013 | B2 | 3/2014 | Crooks et al. | |
| 8,807,140 | B1 | 8/2014 | Scatterday | |
| 8,833,364 | B2 | 9/2014 | Buchberger | |
| 2003/0049025 | A1 | 3/2003 | Neumann et al. | |
| 2004/0003820 | A1 | 1/2004 | Iannuzzi | |
| 2004/0096204 | A1 | 5/2004 | Gerhardinger | |
| 2005/0063686 | A1 | 3/2005 | Whittle et al. | |
| 2005/0211711 | A1 | 9/2005 | Reid | |
| 2005/0268911 | A1 | 12/2005 | Cross et al. | |
| 2007/0074734 | A1 | 4/2007 | Braunshteyn et al. | |
| 2007/0102013 | A1 | 5/2007 | Adams | |
| 2007/0155255 | A1 | 7/2007 | Galauner et al. | |
| 2007/0204858 | A1* | 9/2007 | Abelbeck | 126/41 R |
| 2007/0204868 | A1 | 9/2007 | Bollinger | |
| 2007/0283972 | A1 | 12/2007 | Monsees et al. | |
| 2008/0085139 | A1 | 4/2008 | Roof | |
| 2008/0092912 | A1 | 4/2008 | Robinson et al. | |
| 2008/0216828 | A1 | 9/2008 | Wensley et al. | |
| 2008/0233318 | A1 | 9/2008 | Coyle | |
| 2008/0302374 | A1 | 12/2008 | Wengert et al. | |
| 2009/0032034 | A1 | 2/2009 | Steinberg | |
| 2009/0056728 | A1 | 3/2009 | Baker | |
| 2009/0126745 | A1 | 5/2009 | Hon | |
| 2009/0151717 | A1 | 6/2009 | Bowen et al. | |
| 2009/0272379 | A1 | 11/2009 | Thorens et al. | |
| 2010/0126516 | A1* | 5/2010 | Yomtov et al. | 131/173 |
| 2010/0242975 | A1 | 9/2010 | Hearn | |
| 2011/0094523 | A1 | 4/2011 | Thorens | |
| 2011/0126848 | A1* | 6/2011 | Zuber | A24F 47/008 131/329 |
| 2011/0155153 | A1 | 6/2011 | Thorens et al. | |
| 2012/0006342 | A1 | 1/2012 | Rose et al. | |
| 2012/0255546 | A1 | 10/2012 | Goetz et al. | |
| 2013/0081623 | A1 | 4/2013 | Buchberger | |
| 2014/0182608 | A1 | 7/2014 | Egoyants et al. | |
| 2014/0182843 | A1 | 7/2014 | Vinegar | |
| 2014/0202476 | A1 | 7/2014 | Egoyants et al. | |
| 2014/0216485 | A1 | 8/2014 | Egoyants et al. | |
| 2014/0270726 | A1 | 9/2014 | Egoyants et al. | |
| 2014/0283825 | A1 | 9/2014 | Buchberger | |
| 2014/0299125 | A1 | 10/2014 | Buchberger | |
| 2014/0305449 | A1* | 10/2014 | Plojoux | A24F 47/008 131/328 |
| 2014/0326257 | A1 | 11/2014 | Jalloul et al. | |
| 2014/0360515 | A1 | 12/2014 | Vasiliev et al. | |
| 2015/0040925 | A1 | 2/2015 | Saleem et al. | |
| 2015/0223520 | A1 | 8/2015 | Phillips et al. | |

FOREIGN PATENT DOCUMENTS

| | | | |
|---|---|---|---|
| CN | 1045691 | | 10/1990 |
| CN | 119661 | | 10/1998 |
| CN | 2598364 | | 1/2004 |
| CN | 101238047 | | 8/2008 |
| CN | 101267749 | | 9/2008 |
| CN | 201185656 | | 1/2009 |
| CN | 101557728 | | 10/2009 |
| CN | 201375023 | | 1/2010 |
| DE | 29713866 | | 10/1997 |
| EP | 0358002 | | 3/1990 |
| EP | 0358114 | | 3/1990 |
| EP | 0430559 | | 6/1991 |
| EP | 0438862 | A2 | 7/1991 |
| EP | 0488488 | | 6/1992 |
| EP | 0503767 | | 9/1992 |
| EP | 0603613 | | 6/1994 |
| EP | 2316286 | | 5/2001 |
| EP | 1618803 | | 1/2006 |
| EP | 1736065 | | 12/2006 |
| EP | 2022349 | | 2/2009 |
| EP | 2110033 | | 10/2009 |
| EP | 2327318 | A1 | 6/2011 |
| EP | 2340730 | | 7/2011 |
| EP | 2394520 | | 12/2011 |
| GB | 426247 | | 3/1935 |
| JP | 63127399 | | 8/1988 |
| JP | 03192677 | | 8/1991 |
| JP | 6189861 | | 7/1994 |
| JP | 06315366 | | 11/1994 |
| JP | 08000942 | | 6/1996 |
| JP | 09107943 | | 4/1997 |
| JP | 1189551 | | 4/1999 |
| JP | 11125390 | | 5/1999 |
| JP | 11169157 | | 6/1999 |
| JP | 2005036897 | | 2/2005 |
| JP | 2005106350 | | 4/2005 |
| JP | 2006501871 | | 1/2006 |
| JP | 2008249003 | | 10/2008 |
| JP | 2009537120 | | 10/2009 |
| JP | 2010506594 | | 3/2010 |
| JP | 2010178730 | | 8/2010 |
| JP | 2010213579 | | 9/2010 |
| JP | 2011509667 | | 3/2011 |
| WO | WO0167819 | | 9/2001 |
| WO | WO03037412 | | 5/2003 |
| WO | WO03059413 | | 7/2003 |
| WO | WO03103387 | | 12/2003 |
| WO | WO2007017482 | | 2/2007 |
| WO | WO2007131450 | | 11/2007 |
| WO | WO2008108889 | | 9/2008 |
| WO | WO2009001082 | | 12/2008 |
| WO | WO2009092862 | | 7/2009 |
| WO | WO2010073018 | | 7/2010 |

(56) References Cited

FOREIGN PATENT DOCUMENTS

| | | |
|---|---|---|
| WO | WO2010107613 | 9/2010 |
| WO | WO2010118644 | 10/2010 |
| WO | WO2011050964 | 5/2011 |

OTHER PUBLICATIONS

Application and File History for U.S. Appl. No. 14/127,148, filed Mar. 12, 2014, inventors Egoyants et al.
Application and File History for U.S. Appl. No. 14/127,144, filed Mar. 31, 2014, inventors Egoyants et al.
Application and File History for U.S. Appl. No. 14/127,138, filed Feb. 10, 2014, inventors Egoyants et al.
Application and File History for U.S. Appl. No. 14/127,133, filed Jul. 15, 2014, inventors Vasiliev et al.
Application and File History for U.S. Appl. No. 14/127,879, filed May 9, 2014, inventors Egoyants et al.
International Search Report and Written Opinion, mailed Jan. 9, 2013, for International Application No. PCT/EP2012/066523 filed Aug. 24, 2012.
International Preliminary Report on Patentability, mailed Nov. 4, 2013, for International Application No. PCT/EP2012/066523 filed Aug. 24, 2012.
Search Report dated Mar. 24, 2015, for Chinese Patent Application No. 201280029767.6 filed Aug. 24, 2012 (including English Translation).
International Search Report and Written Opinion, mailed Jan. 9, 2013 for International Application No. PCT/EP2012/066524, filed Aug. 24, 2012.
International Preliminary Report on Patentability, mailed Oct. 17, 2013 for International Application No. PCT/EP2012/066524, filed Aug. 24, 2012.
International Search Report and Written Opinion, mailed Dec. 10, 2012, for PCT/EP2012/066485, filed Aug. 24, 2012.
Written Opinion, mailed Oct. 15, 2013, for PCT/EP2012/066485, filed Aug. 24, 2012.
Office Action and Search Report (with English Translation) mailed Apr. 27, 2015, for CN201280030681.5.
Office Action (with English Translation) mailed Apr. 7, 2015 for JP2014519586.
Warrier et al., "Effect of the Porous Structure of Graphite on Atomic Hydrogen Diffusion and Inventory". Nucl. Fusion 47(2007) 1656-1663, DOI: 10.1088/0029-5515/47/12/003.
Davies et al., (1983) Metallic Foams: Their Production, Properties and Applications. Journal of Materials Science, vol. 18 (7). p. 1899-1911.
International Search Report dated Jul. 18, 2011 issued in corresponding International Patent Application No. PCT/AT2011/000123.
International Search Report and Written Opinion, mailed Jan. 9, 2013, for International Application No. PCT/EP2012/066484, filed Aug. 24, 2012.
International Search Report and Written Opinion mailed Feb. 11, 2014 for PCT/EP2013/057539 filed Apr. 11, 2013.
International Search Report and Written Opinion mailed Jan. 14, 2013 for PCT/EP2012/066486 filed Aug. 24, 2012.
International Preliminary Report on Patentability and response thereto mailed Oct. 22, 2013 for PCT/EP2012/066486 filed Aug. 24, 2012.
Office Action (with English translation) dated Mar. 31, 2015 for JP2014-519585, referencing JP2010-506594, JP03-232481, JP2010-213579, JP62-17980, JP2006-501871, JP4-78508 and JP62-501050.
First Office Action (dated Jun. 15, 2015) and Search Report (dated Jun. 2, 2015) for Chinese Patent Application No. 201280029784.X filed Aug. 24, 2012.
Application and File History for U.S. Appl. No. 14/962,817, filed Dec. 8, 2015, inventors Egoyants et al.

* cited by examiner

HEATING SMOKABLE MATERIAL

CLAIM FOR PRIORITY

This application is the National Stage of International Application No. PCT/EP2012/066525, filed Aug. 24, 2012, which in turn claims priority to and benefit of: RU Patent Application No. 2011136869, filed Sep. 6, 2011; GB Patent Application No. 1207054.6, filed Apr. 23, 2012; and RU Patent Application No. 2012124800, filed Jun. 15, 2012. The entire contents of the aforementioned applications are herein expressly incorporated by reference.

FIELD

The invention relates to heating smokable material.

BACKGROUND

Smoking articles such as cigarettes and cigars burn tobacco during use to create tobacco smoke. Attempts have been made to provide alternatives to these smoking articles by creating products which release compounds without creating tobacco smoke. Examples of such products are so-called heat-not-burn products which release compounds by heating, but not burning, tobacco.

SUMMARY

According to the invention, there is provided an apparatus comprising a smokable material heater, configured to heat a first region of smokable material to a volatizing temperature sufficient to volatize a component of smokable material and to concurrently heat a second region of smokable material to a temperature lower than said volatizing temperature but which is sufficient to prevent condensation of volatized components of the smokable material.

The apparatus may be configured to control the temperature of the first region of smokable material independently of the temperature of the second region of smokable material.

The heater may comprise a plurality of heating regions including a first heating region arranged to heat the first region of smokable material and a second heating region arranged to concurrently heat the second region of smokable material.

The plurality of heating regions may be operable separately and independently to concurrently heat different regions of the smokable material to different temperatures.

The apparatus may be configured to cause the first heating region to heat the first region of smokable material to said volatizing temperature and to cause the second heating region to concurrently heat the second region of smokable material to said lower temperature.

Subsequently, the apparatus may be configured to cause the first heating region to heat the first region of smokable material to said lower temperature and to cause the second heating region to concurrently heat the second region of smokable material to said volatizing temperature.

Subsequently, the apparatus may be configured to cause a third heating region to heat a third region of smokable material to said volatizing temperature and to cause the first and/or second heating region(s) to heat the first and/or second regions of smokable material to said lower temperature.

The apparatus may be configured to successively heat different regions of smokable material to said volatizing temperature whilst concurrently heating regions of smokable material not heated to said volatizing temperature to said lower temperature to prevent condensation of volatized components.

The apparatus may comprise a smokable material heating chamber for containing the smokable material during heating.

The heating chamber may be located adjacent the heater.

The lower temperature may prevent condensation of volatized components in the heating chamber.

The apparatus may comprise a mouthpiece through which volatized components of the smokable material can be inhaled.

The volatizing temperature may be 100 degrees Celsius or higher.

The lower temperature may be less than 100 degrees Celsius.

According to the invention, there is provided a method of manufacturing the apparatus.

According to the invention, there is provided a method of heating smokable material comprising: heating a first region of the smokable material to a volatizing temperature to volatize at least one component of the smokable material for inhalation; and concurrently heating a second region of the smokable material to a temperature lower than the volatizing temperature but which is sufficient to prevent condensation of volatized components of the smokable material.

For exemplary purposes only, embodiments of the invention are described below with reference to the accompanying figures in which:

DETAILED DESCRIPTION

Figure 1:
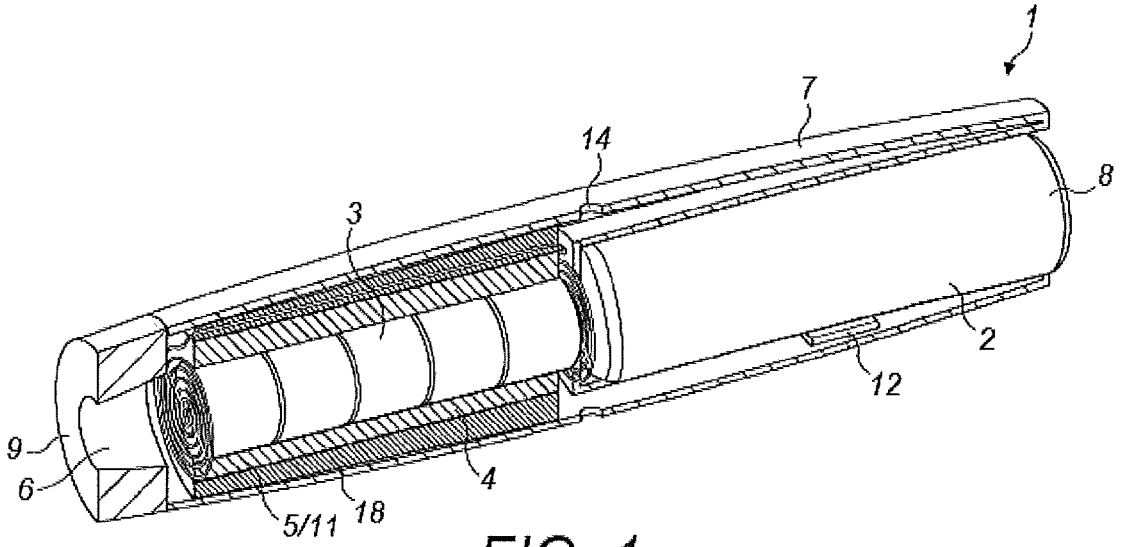
FIG. 1 is a perspective, partially cut-away illustration of an apparatus configured to heat smokable material to release aromatic compounds and/or nicotine from the smokable material.

As used herein, the term 'smokable material' includes any material that provides volatilized components upon heating and includes any tobacco-containing material and may, for example, include one or more of tobacco, tobacco derivatives, expanded tobacco, reconstituted tobacco or tobacco substitutes.

An apparatus 1 for heating smokable material comprises an energy source 2, a heater 3 and a heating chamber 4. The energy source 2 may comprise a battery such as a Li-ion battery, Ni battery, Alkaline battery and/or the like, and is electrically coupled to the heater 3 to supply electrical energy to the heater 3 when required. The heating chamber 4 is configured to receive smokable material 5 so that the smokable material 5 can be heated in the heating chamber 4. The heating chamber 4 is located adjacent to the heater 3 so that thermal energy from the heater 3 heats the smokable material 5 therein to volatilize aromatic compounds and nicotine in the smokable material 5, without burning the smokable material 5. A mouthpiece 6 is provided through which a user of the apparatus 1 can inhale the volatilized compounds during use of the apparatus 1. The smokable material 5 may comprise a tobacco blend.

The heater 3 may comprise a substantially cylindrical, elongate heater 3 and the heating chamber 4 may be located either outwardly or inwardly of a longitudinal external surface of the heater 3. For example, with reference to FIG. 1, the heating chamber 4 may be located around the outside of a circumferential, longitudinal surface of the heater 3. The heating chamber 4 and smokable material 5 may therefore comprise co-axial layers around the heater 3. Alternatively, referring to FIG. 2, the heating chamber 4 may be located internally of the longitudinal surface of the heater 3 so that the heating chamber 4 comprises a core or other cavity internal of the heating surface. As will be evident from the discussion below, other shapes and configurations of the heater 3 and heating chamber 4 can alternatively be used.

Figure 2:
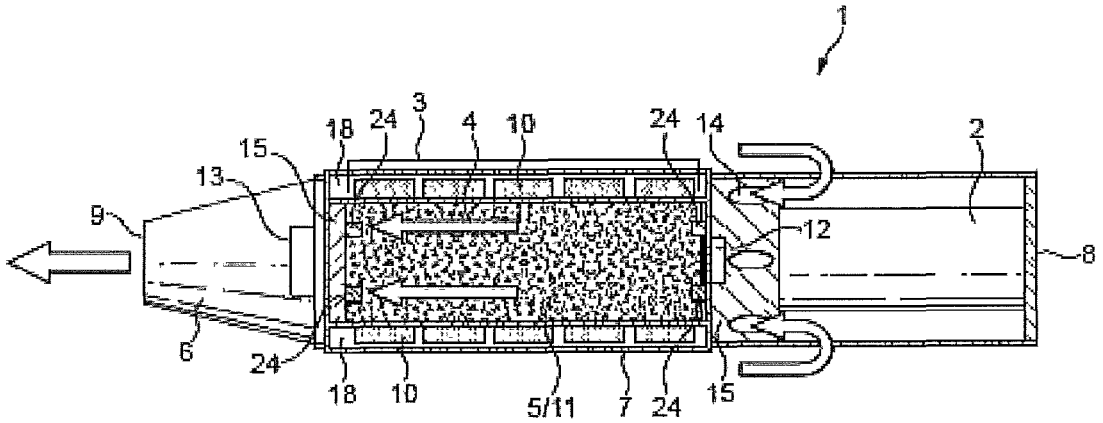
FIG. 2 is an illustration of an apparatus configured to heat smokable material, in which a heater is located externally of a smokable material heating chamber so as to provide heat in a radially inward direction to heat smokable material therein.

A housing 7 may contain components of the apparatus 1 such as the energy source 2 and heater 3. The housing 7 may comprise an approximately cylindrical tube with the energy source 2 located towards its first end 8 and the heater 3 and heating chamber 4 located towards its opposite, second end 9. The energy source 2 and heater 3 extend along the longitudinal axis of the housing 7. For example, as shown in FIGS. 1 and 2, the energy source 2 and heater 3 can be aligned along the central longitudinal axis of the housing 7 in a substantially end-to-end arrangement so that an end face of the energy source 2 substantially faces an end face of the heater 3. Heat insulation may be provided between the energy source 2 and the heater 3 to prevent direct transfer of heat from one to the other.

The length of the housing 7 may be approximately 130 mm, the length of the energy source may be approximately 59 mm, and the length of the heater 3 and heating region 4 may be approximately 50 mm. The diameter of the housing 7 may be between approximately 9 mm and approximately 18 mm. For example, the diameter of the housing's first end 8 may be between 15 mm and 18 mm whilst the diameter of the mouthpiece 6 at the housing's second end 9 may between 9 mm and 15 mm. The diameter of the heater 3 may be between approximately 2.0 mm and approximately 13.0 mm, depending on the heater configuration. For example, a heater 3 located externally of the heating chamber 4 such as that shown in FIG. 2 may have a diameter of between approximately 9.0 mm and approximately 13.0 mm whilst the diameter of a heater 3 located internally of the heating chamber 4, such as that shown in FIG. 1, may be between approximately 2.0 mm and approximately 4.5 mm, such as between approximately 4.0 mm and approximately 4.5 mm or between approximately 2.0 mm and approximately 3.0 mm. Heater diameters outside these ranges may alternatively be used. The diameter of the heating chamber 4 may be between approximately 5.0 mm and approximately 10.0 mm. For example, a heating chamber 4 located outwardly of the heater 3, such as that shown in FIG. 1, may have an exterior diameter of approximately 10 mm at its outwardly-facing surface whilst a heating chamber 4 located inwardly of the heater 3, such as that shown in FIG. 2, may have a diameter of between approximately 5 mm and approximately 8.0 mm such as between approximately 3.0 mm and approximately 6.0 mm. The diameter of the energy source 2 may be between approximately 14.0 mm and approximately 15.0 mm, such as 14.6 mm although other diameters of energy source 2 could equally be used.

The mouthpiece 6 can be located at the second end 9 of the housing 7, adjacent the heating chamber 4 and smokable material 5. The housing 7 is suitable for being gripped by a user during use of the apparatus 1 so that the user can inhale volatilized smokable material compounds from the mouthpiece 6 of the apparatus 1.

Figure 5:
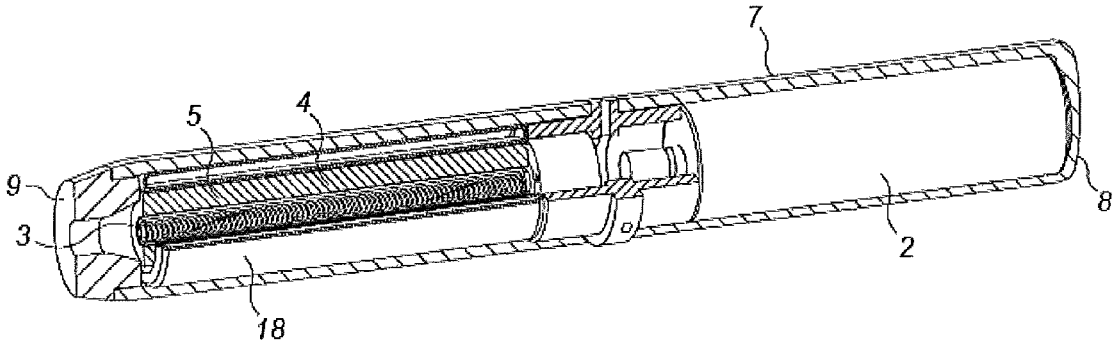
FIG. 5 is a perspective, partially cut-away illustration of an apparatus configured to heat smokable material, in which the smokable material is provided around an elongate infra-red heater.
Figure 6:
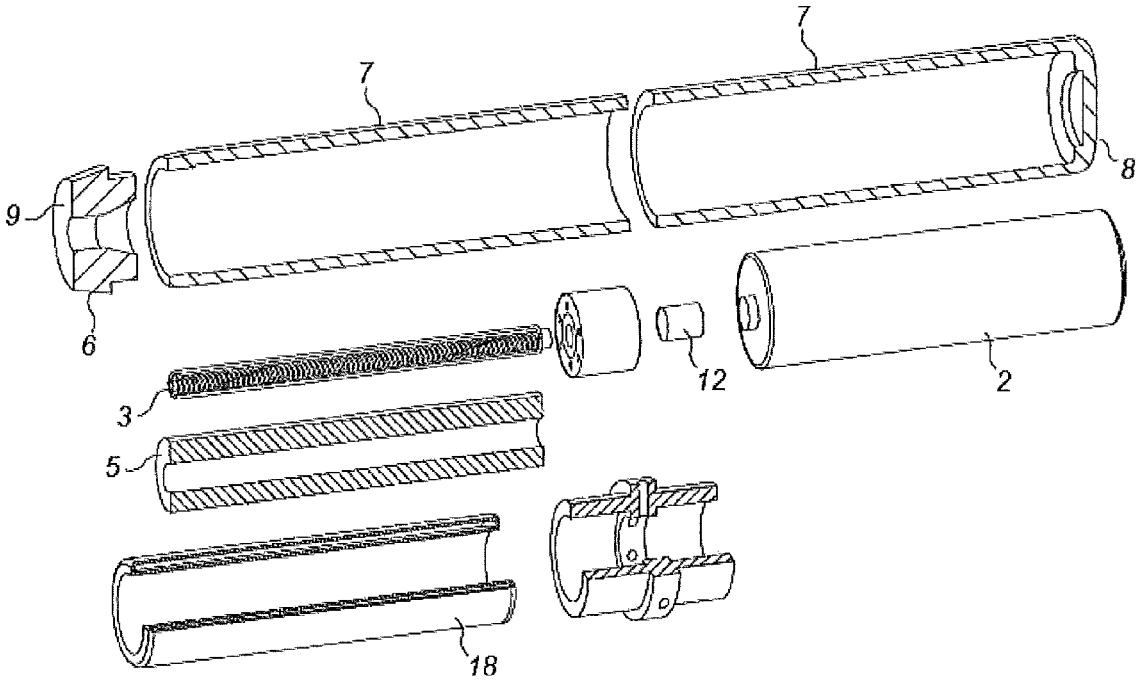
FIG. 6 is an exploded, partially cut-away illustration of an apparatus configured to heat smokable material, in which the smokable material is provided around an elongate infra-red heater.

The heater 3 may comprise a ceramics heater 3, examples of which are shown in FIGS. 1 to 4. The ceramics heater 3 may, for example, comprise base ceramics of alumina and/or silicon nitride which are laminated and sintered. Alternatively, referring to FIGS. 5 and 6, the heater 3 may comprise an infra-red (IR) heater 3 such as a halogen-IR lamp 3. The IR heater 3 may have a low mass and therefore its use can help to reduce the overall mass of the apparatus 1. For example, the mass of the IR heater may be 20% to 30% less than the mass of a ceramics heater 3 having an equivalent heating power output. The IR heater 3 also has low thermal inertia and therefore is able to heat the smokable material 5 very rapidly in response to an activation stimulus. The IR heater 3 may be configured to emit IR electromagnetic radiation of between approximately 700 nm and 4.5 μm in wavelength. Another alternative is to use a resistive heater 3, such as a resistive wire wound on a ceramic insulation layer deposited on a wall of the thermal insulation 18 referred to further below.

As indicated above and shown in FIG. 1, the heater 3 may be located in a central region of the housing 7 and the heating chamber 4 and smokable material 5 may be located around the longitudinal surface of the heater 3. In this arrangement, thermal energy emitted by the heater 3 may travel in a radial direction outwards from the longitudinal surface of the heater 3 into the heating chamber 4 and the smokable material 5. Alternatively, as shown in FIG. 2, the heater 3 may be located towards the periphery of the housing 7 and the heating chamber 4 and smokable material 5 may be located in a central region of the housing 7 which is internal from the longitudinal surface of the heater 3. In this arrangement, thermal energy emitted by the heater 3 travels in a radial direction inwards from a longitudinal surface of the heater 3 into the heating chamber 4 and the smokable material 5.

Figure 3:
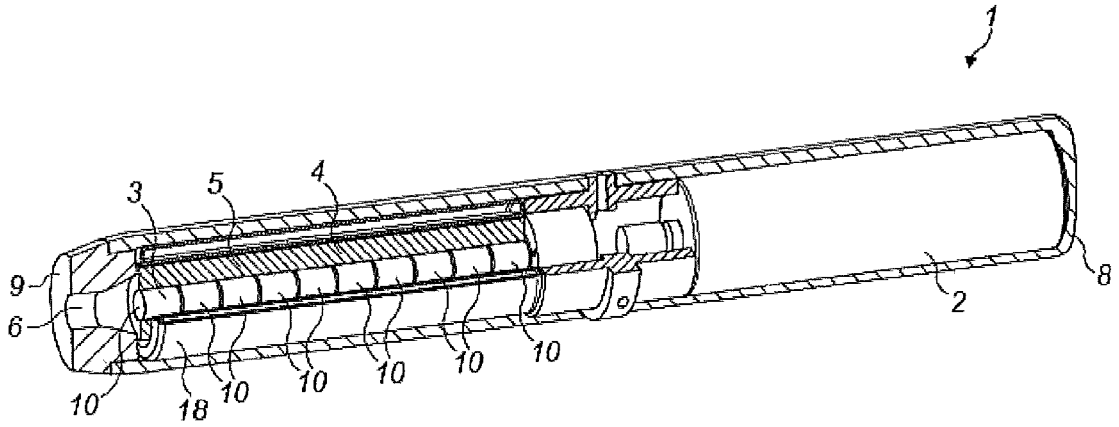
FIG. 3 is a perspective, partially cut-away illustration of an apparatus configured to heat smokable material, in which the smokable material is provided around an elongate ceramic heater divided into radial heating sections.

The heater 3 comprises a plurality of individual heating regions 10, as shown in FIGS. 2 and 3. The heating regions 10 are operable independently of one another so that different regions 10 can be activated at different times to heat the smokable material 5. The heating regions 10 may be arranged in the heater 3 in any geometric arrangement. However, in the examples shown in the figures, the heating regions 10 are geometrically arranged in the heater 3 so that different ones of the heating regions 10 are arranged to predominately and independently heat different regions of the smokable material 5.

For example, referring to FIGS. 2 and 3, the heater 3 may comprise a plurality of axially aligned heating regions 10 in a substantially elongate arrangement. The regions 10 may each comprise an individual element of the heater 3. The heating regions 10 may, for example, all be aligned with each other along a longitudinal axis of the heater 3, thus providing a plurality of independent heating zones along the length of the heater 3. Each heating region 10 may comprise a heating cylinder 10 having a finite length which is significantly less than the length of the heater 3 as a whole. The cylinders 10 may comprise solid disks where each disk has a depth equivalent to the cylinder length referred to above. An example of this is shown in FIG. 3. Alternatively, the cylinders 10 may comprise hollow rings, an example of which is shown in FIG. 2. In this case, the arrangement of axially aligned heating regions 10 define the exterior of the heating chamber 4 and are configured to apply heat inwardly, predominately towards the central longitudinal axis of the chamber 4. The heating regions 10 are arranged with their radial, or otherwise transverse, surfaces facing one another along the length of the heater 3. The transverse surfaces of each region 10 may touch the transverse surfaces of its neighbouring regions 10. Alternatively, the transverse surfaces of each region 10 may be separated from the transverse surfaces of its neighbouring region(s) 10. Thermal insulation 18 may be present between such separated heating regions 10, as discussed in more detail below. An example of this is shown in FIG. 2.

In this way, when a particular one of the heating regions 10 is activated, it supplies thermal energy to the smokable material 5 located radially inwardly or outwardly of the heating region 10 without substantially heating the remainder of the smokable material 5. For example, referring to FIG. 3, the heated region of smokable material 5 may comprise a ring of smokable material 5 located around the heating region 10 which has been activated. The smokable material 5 can therefore be heated in independent sections, for example ring or core sections, where each section corresponds to smokable material 5 located directly inwardly or outwardly of a particular one of the heating regions 10 and has a mass and volume which is significantly less than the body of smokable material 5 as a whole.

Figure 7:
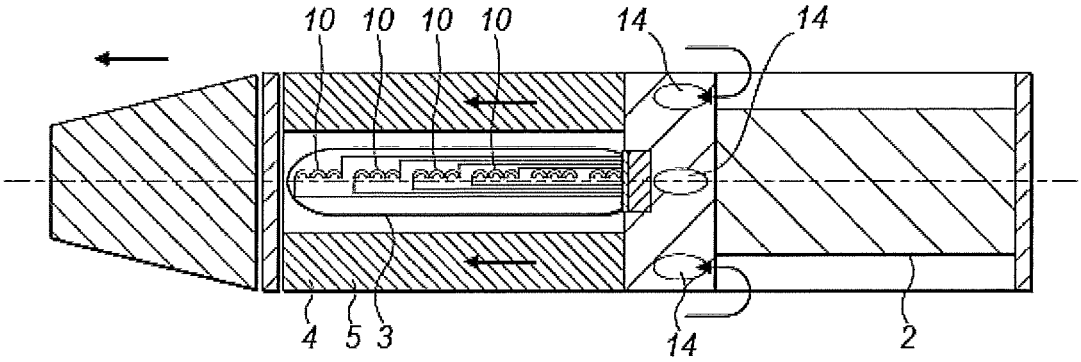
FIG. 7 is a schematic illustration of part of an apparatus configured to heat smokable material, in which the smokable material is provided around a plurality of longitudinal, elongate heating sections spaced around a central longitudinal axis.

In another alternative configuration, referring to FIG. 7, the heater 3 may comprise a plurality of elongate, longitudinally extending heating regions 10 positioned at different locations around the central longitudinal axis of the heater 3. Although shown as being of different lengths in FIG. 7, the longitudinally extending heating regions 10 may be of substantially the same length so that each extends along substantially the whole length of the heater 3. Each heating region 10 may comprise, for example, an individual IR heating element 10 such as an IR heating filament 10. Optionally, a body of heat insulation or heat reflective material may be provided along the central longitudinal axis of the heater 3 so that thermal energy emitted by each heating region 10 travels predominately outwards from the heater 3 into the heating chamber 4 and thus heats the smokable material 5. The distance between the central longitudinal axis of the heater 3 and each of the heating regions 10 may be substantially equal. The heating regions 10 may optionally be contained in a substantially infra-red and/or heat transparent tube, or other housing, which forms a longitudinal surface of the heater 3. The heating regions 10 may be fixed in position relative to the other heating regions 10 inside the tube.

In this way, when a particular one of the heating regions 10 is activated, it supplies thermal energy to the smokable material 5 located adjacent to the heating region 10 without substantially heating the remainder of the smokable material 5. The heated section of smokable material 5 may comprise a longitudinal section of smokable material 5 which lies parallel and directly adjacent to the longitudinal heating region 10. Therefore, as with the previous examples, the smokable material 5 can be heated in independent sections.

As will be described further below, the heating regions 10 can each be individually and selectively activated.

The smokable material 5 may be comprised in a cartridge 11 which can be inserted into the heating chamber 4. For example, as shown in FIG. 1, the cartridge 11 can comprise a smokable material tube 11 which can be inserted around the heater 3 so that the internal surface of the smokable material tube 11 faces the longitudinal surface of the heater 3. The smokable material tube 11 may be hollow. The diameter of the hollow centre of the tube 11 may be substantially equal to, or slightly larger than, the diameter of the heater 3 so that the tube 11 is a close fit around the heater 3. Alternatively, referring to FIG. 2, the cartridge 11 may comprise a substantially solid rod of smokable material 5 which can be inserted into a heating chamber 4 located inwardly of the heater 3 so that the external longitudinal surface of the rod ii faces the internal longitudinal surface of the heater 3. The length of the cartridge 11 may be approximately equal to the length of the heater 3 so that the heater 3 can heat the cartridge 11 along its whole length.

In another alternative configuration of heater 3, the heater 3 comprises a spirally shaped heater 3. The spirally shaped heater 3 may be configured to screw into the smokable material cartridge n and may comprise adjacent, axially-aligned heating regions 10 so as to operate in substantially the same manner as described for the linear, elongate heater 3 discussed above with reference to FIGS. 1 and 3.

Figure 8:
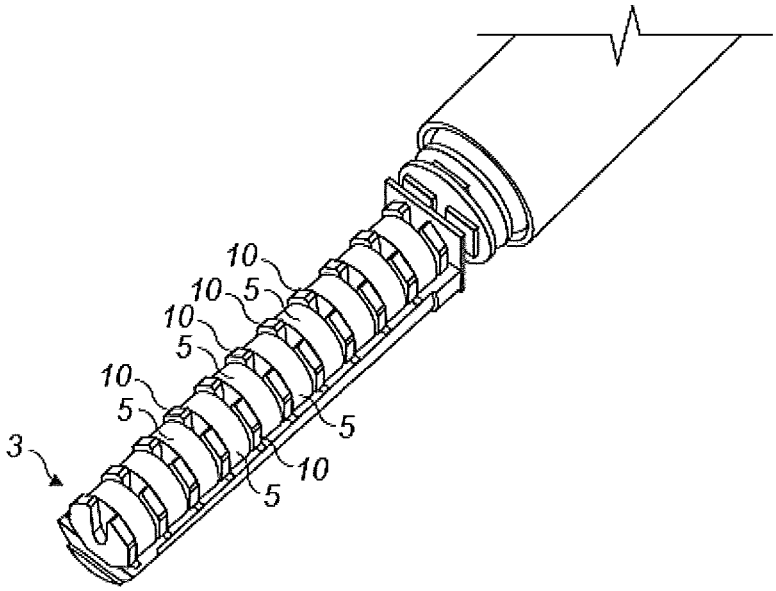
FIG. 8 is a perspective illustration of part of an apparatus configured to heat smokable material, in which the regions of smokable material are provided between pairs of upstanding heating plates.
Figure 9:
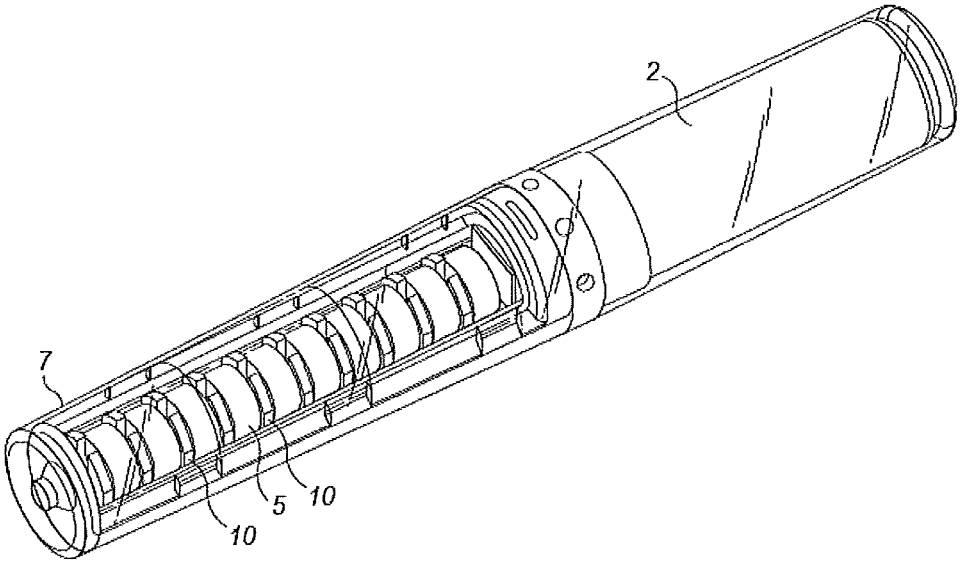
FIG. 9 is a perspective illustration of the apparatus shown in FIG. 7, in which an external housing is additionally illustrated.
Figure 10:
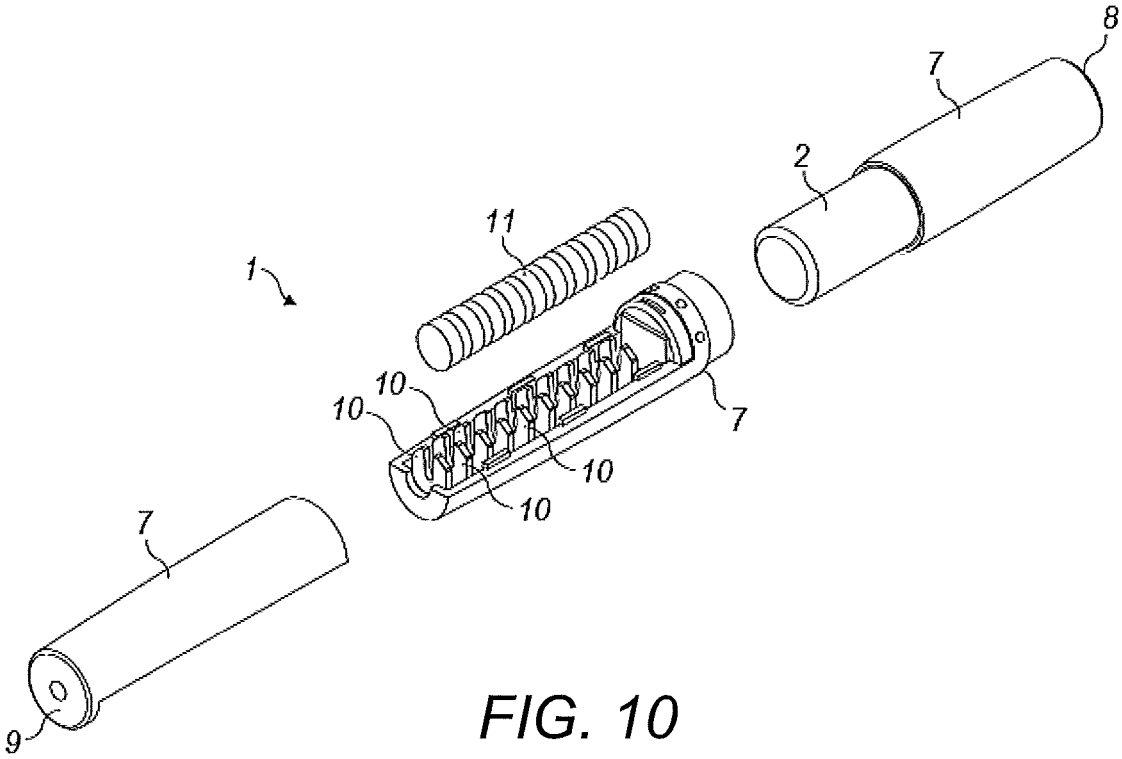
FIG. 10 is an exploded view of part of an apparatus configured to heat smokable material, in which the regions of smokable material are provided between pairs of upstanding heating plates.

Alternatively, referring to FIGS. 8, 9 and 10, a different geometrical configuration of heater 3 and smokable material 5 can be used. More particularly, the heater 3 can comprise a plurality of heating regions 10 which extend directly into an elongate heating chamber 4 which is divided into sections by the heating regions 10. During use, the heating regions 10 extend directly into an elongate smokable material cartridge 11 or other substantially solid body of smokable material 5. The smokable material 5 in the heating chamber 4 is thereby divided into discrete sections separated from each other by the spaced-apart heating regions 10. The heater 3, heating chamber 4 and smokable material 5 may extend together along a central, longitudinal axis of the housing 7. As shown in FIGS. 8 and 10, the heating regions 10 may each comprise a projection 10, such as an upstanding heating plate 10, which extends into the body of smokable material 5. The projections 10 are discussed below in the context of heating plates 10. The principal plane of the heating plates 10 may be substantially perpendicular to the principal longitudinal axis of the body of smokable 5 and heating chamber 4 and/or housing 7. The heating plates 10 may be parallel to one another, as shown in FIGS. 8 and 10. Each section of smokable material 5 is bounded by a main heating surface of a pair of heating plates 10 located either side of the smokable material section, so that activation of one or both of the heating plates 10 will cause thermal energy to be transferred directly into the smokable material 5. The heating surfaces may be embossed to increase the surface area of the heating plate 10 against the smokable material 5. Optionally, each heating plate 10 may comprise a thermally reflective layer which divides the plate 10 into two halves along its principal plane. Each half of the plate 10 can thus constitute a separate heating region 10 and may be independently activated to heat only the section of smokable material 5 which lies directly against that half of the plate 10, rather than the smokable material 5 on both sides of the plate 10. Adjacent plates 10, or facing portions thereof, may be activated to heat a section of smokable material 5, which is located between the adjacent plates, from substantially opposite sides of the section of smokable material 5.

The elongate smokable material cartridge or body 11 can be installed between, and removed from, the heating chamber 4 and heating plates 10 by removing a section of the housing 7 at the housing's second end 9, as previously described. The heating regions 10 can be individually and selectively activated to heat different sections of the smokable material 5 as required.

In this way, when a particular one or pair of the heating regions 10 is activated, it supplies thermal energy to the smokable material 5 located directly adjacent to the heating region(s) 10 without substantially heating the remainder of the smokable material 5. The heated section of smokable material 5 may comprise a radial section of smokable material 5 located between the heating regions 10, as shown in FIGS. 8 to 10.

The housing 7 of the apparatus 1 may comprise an opening through which the cartridge 11 can be inserted into the heating chamber 4. The opening may, for example, comprise an opening located at the housing's second end 9 so that the cartridge 11 can be slid into the opening and pushed directly into the heating chamber 4. The opening is preferably closed during use of the apparatus 1 to heat the smokable material 5. Alternatively, a section of the housing 7 at the second end 9 is removable from the apparatus 1 so that the smokable material 5 can be inserted into the heating chamber 4. An example of this is shown in FIG. 10. The apparatus 1 may optionally be equipped with a user-operable smokable material ejection unit, such as an internal mechanism configured to slide used smokable material 5 off and/or away from the heater 3. The used smokable material 5 may, for example, be pushed back through the opening in the housing 7. A new cartridge 11 can then be inserted as required.

Figure 14:
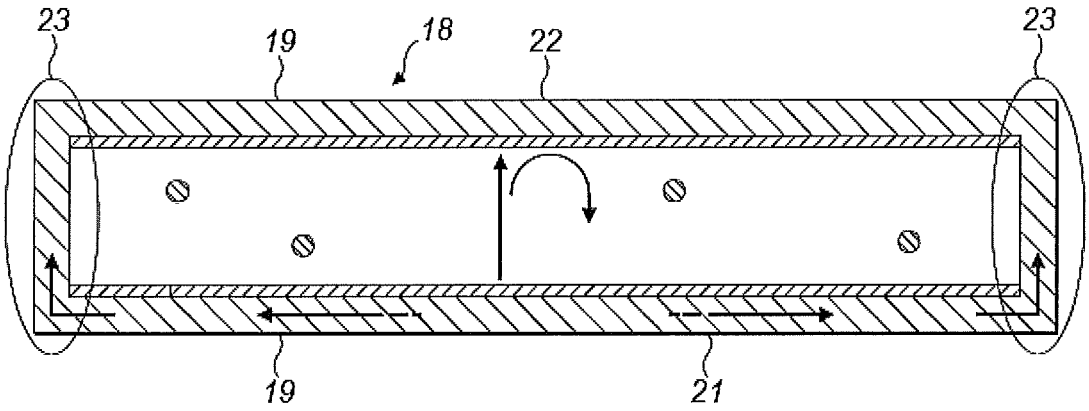
FIG. 14 is a schematic, cross-sectional illustration of a section of vacuum insulation configured to insulate heated smokable material from heat loss.

Thermal insulation 18 may be provided between the smokable material 5 and an external surface 19 of the housing 7. The thermal insulation reduces heat loss from the apparatus 1 and therefore improves the efficiency with which the smokable material 5 is heated. Referring to FIG. 14, the insulation 18 may comprise vacuum insulation 18. For example, the insulation 18 may comprise a layer which is bounded by a wall material 19 such as a metallic material. An internal region or core 20 of the insulation 18 may comprise an open-cell porous material, for example comprising polymers, aerogels or other suitable material, which is evacuated to a low pressure. The internal region 20 of the insulation 18 is configured to absorb gases which may be generated inside the region 20 to thereby maintain a vacuum state. The pressure in the internal region 20 may be in the range of 0.1 to 0.001 mbar. The wall 19 of the insulation 18 is sufficiently strong to withstand the force exerted against it due to the pressure differential between the core 20 and external surfaces of the wall 19, thereby preventing the insulation 18 from collapsing. The wall 19 may, for example, comprise a stainless steel wall 19 having a thickness of approximately 100 μm. The thermal conductivity of the insulation 18 may be in the range of 0.004 to 0.005 W/mK. The heat transfer coefficient of the insulation 18 may be between approximately 1.10 $W/(m^2K)$ and approximately 1.40 $W/(m^2K)$ within a temperature range of between approximately 100 degrees Celsius and 250 degrees Celsius, such as within a range of between approximately 150 degrees Celsius and approximately 250 degrees Celsius. The gaseous conductivity of the insulation 18 is negligible. A reflective coating may be applied to the internal surfaces of the wall material 19 to minimize heat losses due to radiation propagating through the insulation 18. The coating may, for example, comprise an aluminium IR reflective coating having a thickness of between approximately 0.3 μm and 1.0 μm. The evacuated state of the internal core region 20 means that the insulation 18 functions even when the thickness of the core region 20 is very small. The insulating properties are substantially unaffected by its thickness. This helps to reduce the overall size, particularly the diameter, of the apparatus 1.

As shown in FIG. 14, the wall 19 comprises an inwardly-facing section 21 and an outwardly-facing section 22. The inwardly-facing section 21 substantially faces the smokable material 5 and heating chamber 4. The outwardly-facing section 22 substantially faces the exterior of the housing 7. During operation of the apparatus 1, the inwardly-facing section 21 may be warmer due to the thermal energy originating from the heater 3, whilst the outwardly-facing section 22 is cooler due to the effect of the insulation 18. The inwardly-facing section 21 and the outwardly-facing section 22 may both comprise substantially longitudinally-extending walls 19 which are at least as long as the heater 3 and heating chamber 4. The internal surface of the outwardly-facing wall section 22, i.e. the surface facing the evacuated core region 20, may comprise a coating for absorbing gas in the core 20. A suitable coating is a titanium oxide film.

As illustrated in FIG. 2, the overall length of the body of insulation 18 may be greater than the length of the heating chamber 4 and heater 3 so as to further reduce heat loss from the apparatus 1 to the atmosphere outside the housing 7. For example, the thermal insulation 18 may be between approximately 70 mm and approximately 80 mm.

Figure 15:
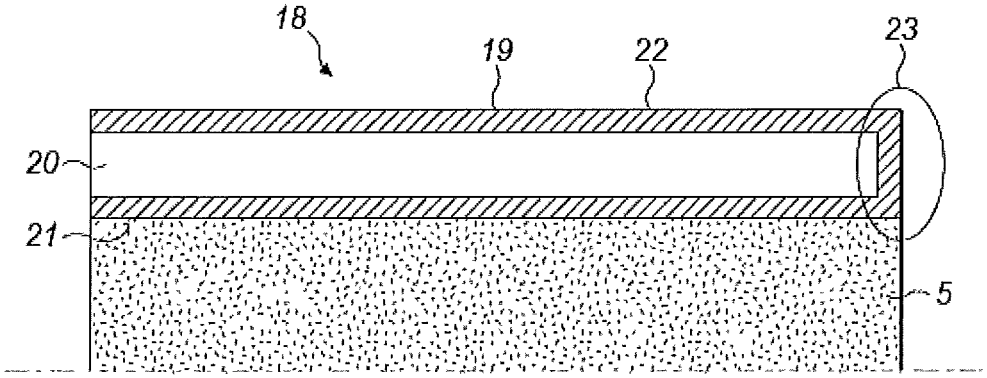
FIG. 15 is another schematic, cross-sectional illustration of a section of vacuum insulation configured to insulate heated smokable material from heat loss.

Referring to the schematic illustrations in FIGS. 14 and 15, a thermal bridge 23 may connect the inwardly-facing wall section 21 to the outwardly-facing wall section 22 at the ends of the insulation 18 in order to completely encompass and contain the low pressure core 20. The thermal bridge 23 may comprise a wall 19 formed of the same material as the inwardly and outwardly-facing sections 21, 22. A suitable material is stainless steel, as previously discussed. The thermal bridge 23 has a greater thermal conductivity than the insulating core 20 and so has a greater potential to undesirably conduct heat out of the apparatus 1 and thereby reduce the efficiency with which the smokable material 5 is heated than the core 20.

Figure 16:
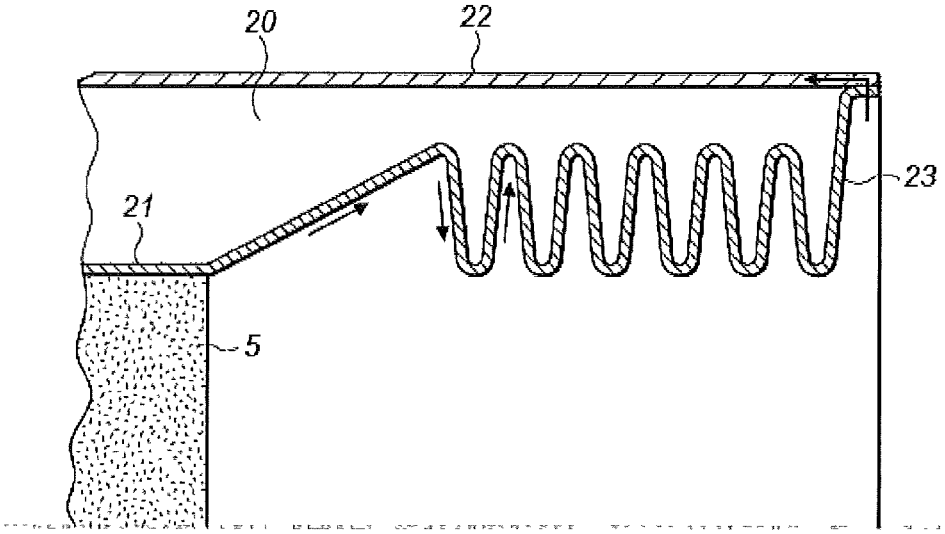
FIG. 16 is a schematic, cross-sectional illustration of a heat resistive thermal bridge which follows an indirect path from a higher temperature insulation wall to a lower temperature insulation wall.

To reduce heat losses due to the thermal bridge 23, the thermal bridge 23 may be extended to increase its resistance to heat flow from the inwardly-facing section 21 to the outwardly-facing section 22. This is schematically illustrated in FIG. 16. For example, the thermal bridge 23 may follow an indirect path between the inwardly-facing section 21 of the wall 19 and the outwardly-facing section 22 of the wall 19. The thermal bridge 23 is present at a longitudinal location in the apparatus 1 where the heater 3 and heating chamber 4 are not present. This means that the thermal bridge 23 gradually extends from the inwardly-facing section 21 to the outwardly-facing section 22 along the indirect path, thereby reducing the thickness of the core 20 to zero, at a longitudinal location in the housing 7 where the heater 3, heating chamber 4 and smokable material 5 are not present, thereby further limiting the conduction of heat out of the apparatus 1.

As referred to above with reference to FIG. 2, the heater 3 may be integrated with the thermal insulation 18. For example, the thermal insulation 18 may comprise a substantially elongate, hollow body, such as a substantially cylindrical tube of insulation 18 which is located co-axially around the heating chamber 4 and into which the heating regions 10 are integrated. The thermal insulation 18 may comprise a layer in which recesses are provided in the inwardly facing surface profile 21. Heating regions 10 are located in these recesses so that the heating regions 10 face the smokable material 5 in the heating chamber 4. The surfaces of the heating regions 10 which face the heating chamber 4 may be flush with the inside surface 21 of the thermal insulation 18 in regions of the insulation 18 which are not recessed.

Integrating the heater 3 with the thermal insulation 18 means that the heating regions 10 are substantially surrounded by the insulation 18 on all sides of the heating regions 10 other than those which face inwardly towards the smokable material heating chamber 4. As such, heat emitted by the heater 3 is concentrated in the smokable material 5 and does not dissipate into other parts of the apparatus 1 or into the atmosphere outside the housing 7.

The integration of the heater 3 with the thermal insulation 18 also reduces the thickness of the combination of heater 3 and thermal insulation 18 compared to providing the heater 3 separately and internally of a layer of thermal insulation 18. This can allow the diameter of the apparatus 1, in particular the external diameter of the housing 7, to be reduced resulting in a conveniently sized slim-line product.

Alternatively, the reduction in thickness provided by the integration of the heater 3 with the thermal insulation 18 can allow a wider smokable material heating chamber 4 to be accommodated in the apparatus 1, or the introduction of further components, without any increase in the overall width of the housing 7, as compared to a device in which the heater 3 is separate and positioned internally from a layer of thermal insulation 18.

A benefit of integrating the heater 3 with the insulation 18 is that the size and weight of the combination of heater 3 and insulation 18 can be reduced compared to devices in which there is no integration of heater and insulation. Reduction of the heater size allows for a corresponding reduction in the diameter of the housing. Reduction of the heater weight, in turn, decreases the heating ramp-up time and thereby reduces the warming-up time of the apparatus 1.

Additionally or alternatively to the thermal insulation 18, a heat reflecting layer may be present between the transverse surfaces of the heating regions 10. The arrangement of the heating regions 10 relative to each other may be such that thermal energy emitted from each one of the heating regions 10 does not substantially heat the neighbouring heating regions 10 and instead travels predominately into the heating chamber 4 and smokable material 5. Each heating region 10 may have substantially the same dimensions as the other regions 10.

Figure 4:
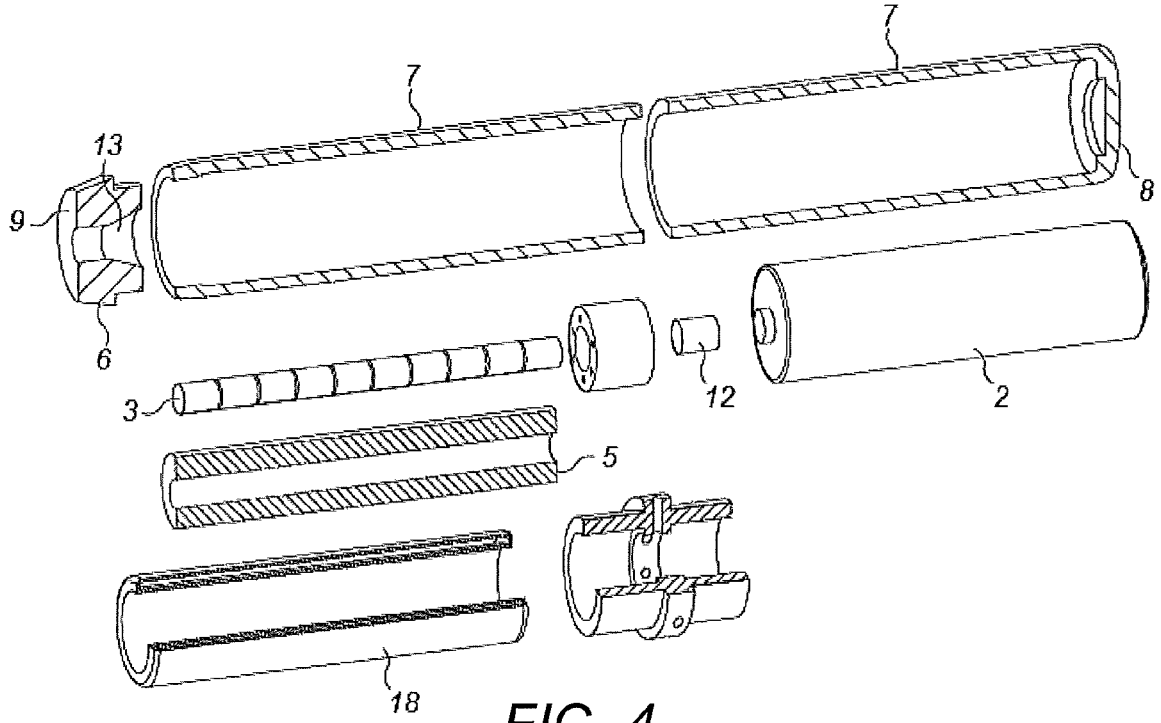
FIG. 4 is an exploded, partially cut-away view of an apparatus configured to heat smokable material, in which the smokable material is provided around an elongate ceramic heater divided into radial heating sections.

The apparatus 1 may comprise a controller 12, such as a microcontroller 12, which is configured to control operation of the apparatus 1. The controller 12 is electronically connected to the other components of the apparatus 1 such as the energy source 2 and heater 3 so that it can control their operation by sending and receiving signals. The controller 12 is, in particular, configured to control activation of the heater 3 to heat the smokable material 5. For example, the controller 12 may be configured to activate the heater 3, which may comprise selectively activating one or more heating regions 10, in response to a user drawing on the mouthpiece 6 of the apparatus 1. In this regard, the controller 12 may be in communication with a puff sensor 13 via a suitable communicative coupling. The puff sensor 13 is configured to detect when a puff occurs at the mouthpiece 6 and, in response, is configured to send a signal to the controller 12 indicative of the puff. An electronic signal may be used. The controller 12 may respond to the signal from the puff sensor 13 by activating the heater 3 and thereby heating the smokable material 5. The use of a puff sensor 13 to activate the heater 3 is not, however, essential and other means for providing a stimulus to activate the heater 3, such as a user-operable actuator, can alternatively be used. The volatilized compounds released during heating can then be inhaled by the user through the mouthpiece 6. The controller 12 can be located at any suitable position within the housing 7. An example position is between the energy source 2 and the heater 3/heating chamber 4, as illustrated in FIG. 4. The controller 12 may be configured to activate, or otherwise cause warming of, the individual heating regions 10 in a predetermined order or pattern. For example, the controller 12 may be configured to activate the heating regions 10 sequentially along or around the heating chamber 4. Each activation of a heating region 10 may be in response to detection of a puff by the puff sensor 13 or may be triggered in an alternative way such as by the elapse of a predetermined period of time after the activation of the previous heating region 10 or by elapse of a predetermined period of time after initial activation of the heater (e.g. activation of the first region 10), as described further below.

Figure 11:
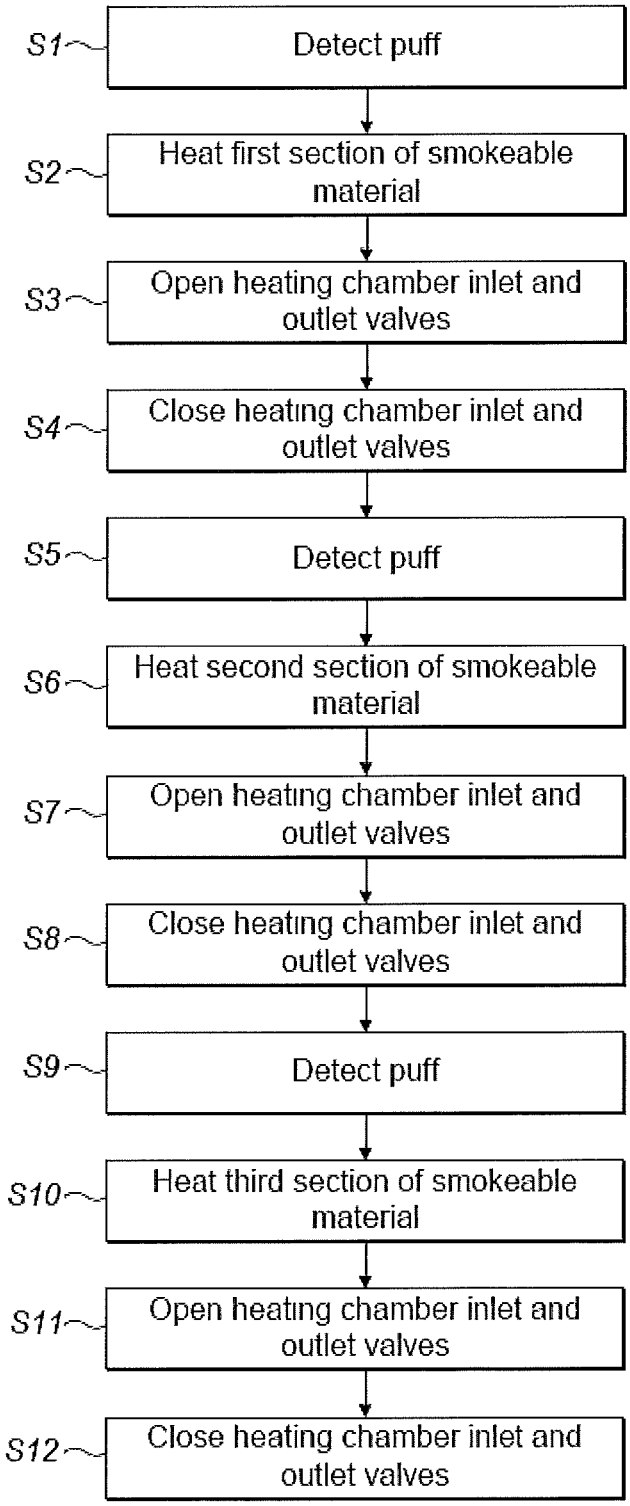
FIG. 11 is a flow diagram showing a method of activating heating regions and opening and closing heating chamber valves during puffing.

Referring to FIG. 11, an example heating method may comprise a first step S1 in which an activation stimulus such as a first puff is detected followed by a second step S2 in which a first section of smokable material 5 is heated in response to the activation stimulus. In a third step S3, hermetically sealable inlet and outlet valves 24 may be opened to allow air to be drawn through the heating chamber 4 and out of the apparatus 1 through the mouthpiece 6. In a fourth step, the valves 24 are closed. These valves 24 are described in more detail below with respect to FIGS. 2 and 18. In fifth S5, sixth S6, seventh S7 and eighth S8 steps, a second section of smokable material 5 may be heated, for example in response to another activation stimulus such as a second puff, with a corresponding opening and closing of the heating chamber inlet and outlet valves 24. In ninth S9, tenth S10, eleventh S11 and twelfth S12 steps, a third section of the smokable material 5 may be heated, for example in response to another activation stimulus such as a third puff, with a corresponding opening and closing of the heating chamber inlet and outlet valves 24, and so on. Means other than a puff sensor 13 could alternatively be used. For example, a user of the apparatus 1 may actuate a control switch to indicate that he/she is taking a new puff.

In this way, a fresh section of smokable material 5 may be heated to volatilize nicotine and aromatic compounds for each new puff or in response to a given quantity of certain components, such as nicotine and/or aromatic compounds, being released from the previously heated section of smokable material 5. The number of heating regions 10 and/or independently heatable sections of smokable material 5 may correspond to the number of puffs for which the cartridge 11 is intended to be used. Alternatively, each independently heatable smokable material section 5 may be heated by its corresponding heating region(s) 10 for a plurality of puffs such as two, three or four puffs, so that a fresh section of smokable material 5 is heated only after a plurality of puffs have been taken whilst heating the previous smokable material section.

As briefly referred to above, instead of activating each heating region 10 in response to an individual puff, the heating regions 10 may alternatively be activated sequentially, for example over a predetermined period of use, one after the other. This may occur in response to an initial activation stimulus such as a single, initial puff at the mouthpiece 6. For example, the heating regions 10 may be activated at regular, predetermined intervals over the expected inhalation period for a particular smokable material cartridge 11. The predetermined intervals may correspond to the period which is taken to release a given amount of certain components such as nicotine and/or aromatic compounds from each smokable material section. An example interval is between approximately 60 and 240 seconds. Therefore, at least the fifth and ninth steps S5, S9 shown in FIG. 11 are optional. Each heating region 10 may continue to be activated for a predetermined period, which may correspond to the duration of the intervals referred to above or may be longer, as described below. Once all of the heating regions 10 have been activated for a particular cartridge 11, the controller 12 may be configured to indicate to the user that the cartridge 11 should be changed. The controller 12 may, for example, activate an indicator light at the external surface of the housing 7.

It will be appreciated that activating individual heating regions 10 in order rather than activating the entire heater 3 means that the energy required to heat the smokable material 5 is reduced over what would be required if the heater 3 were activated fully over the entire inhalation period of a cartridge 11. Therefore, the maximum required power output of the energy source 2 is also reduced. This means that a smaller and lighter energy source 2 can be installed in the apparatus 1.

The controller 12 may be configured to de-activate the heater 3, or reduce the power being supplied to the heater 3, in between puffs. This saves energy and extends the life of the energy source 2. For example, upon the apparatus 1 being switched on by a user or in response to some other stimulus, such as detection of a user placing their mouth against the mouthpiece 6, the controller 12 may be configured to cause the heater 3, or next heating region 10 to be used to heat the smokable material 5, to be partially activated so that it heats up in preparation to volatilize components of the smokable material 5. The partial activation does not heat the smokable material 5 to a sufficient temperature to volatilize nicotine. A suitable temperature may be 100° C. or below, although temperatures below 120° C. could be used. An example is a temperature between 60° C. and 100° C., such as a temperature between 80° C. and 100° C. The temperature may be less than 100° C. In response to detection of a puff by the puff sensor 13, or some other stimulus such as the elapse of a predetermined time period, the controller 12 may then cause the heater 3 or heating region 10 in question to heat the smokable material 5 further in order to rapidly volatilize the nicotine and other aromatic compounds for inhalation by the user. The temperature of a partially heated heating region 10 can be increased to full volatizing temperature in a shorter time period than if the heating region 10 was started from 'cold', i.e. without being partially heated.

Figure 13:
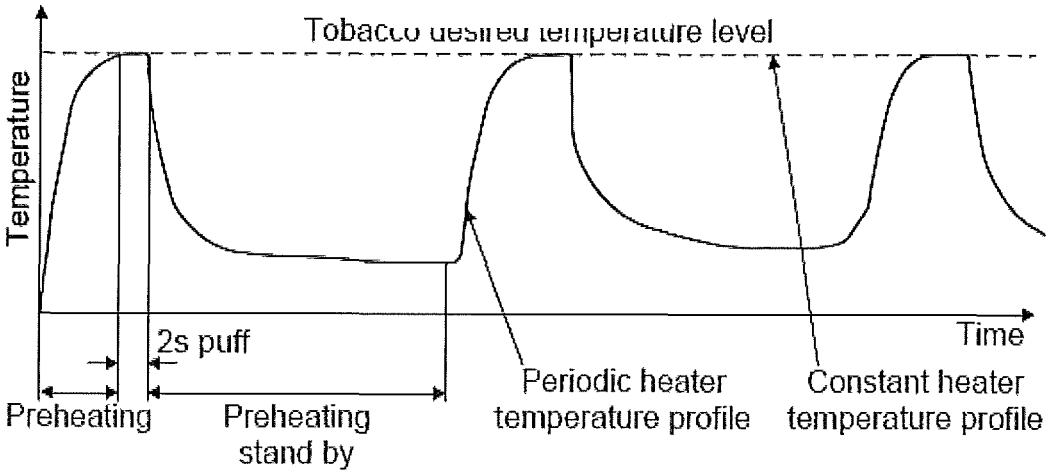
FIG. 13 is a graphical illustration of a heating pattern which can be used to heat smokable material using a heater.

If the smokable material 5 comprises tobacco, a suitable temperature for volatilizing the nicotine and other aromatic compounds may be 100° C. or above, such as 120° C. or above. An example is a temperature between 100° C. and 250° C., such as between 100° C. and 220° C., between 100° C. and 200° C., between 150° C. and 250° C. or between 130° C. and 180° C. The temperature may be more than 100° C. An example full activation temperature is 150° C., although other values such as 250° C. are also possible. A super-capacitor can optionally be used to provide the peak current used to heat the smokable material 5 to the volatization temperature. An example of a suitable heating pattern is shown in FIG. 13, in which the peaks may respectively represent the full activation of different heating regions 10. As can be seen, the smokable material 5 is maintained at the volatization temperature for the approximate period of the puff which, in this example, is two seconds.

Three example operational modes of the heater 3 are described below.

In a first operational mode, during full activation of a particular heating region 10, all other heating regions 10 of the heater are deactivated. Therefore, when a new heating region 10 is activated, the previous heating region is deactivated. Power is supplied only to the activated region 10. The heating regions 10 may be activated sequentially along the length of the heater 3 so that nicotine and aromatic compounds are regularly released from fresh portions of smokable material 5 until the cartridge 11 is exhausted. This mode provides more uniform nicotine and smokable material flavour delivery than full activation of all heating regions 10 for the duration of the heating period of the cartridge 11. As with the other modes described below, power is also saved by not fully activating all of the heating regions 10 for the duration of the heating period of the smokable material cartridge 11.

Alternatively, in a second operational mode, once a particular heating region 10 has been activated, it remains fully activated until the heater 3 is switched off. Therefore, the power supplied to the heater 3 incrementally increases as more of the heating regions 10 are activated during inhalation from the cartridge 11. The continuing activation of the heating regions 10 throughout the chamber 4 substantially prevents condensation of components such as nicotine volatized from the smokable material 5 in the heating chamber 4.

Alternatively, in a third operational mode, during full activation of a particular heating region 10, one or more of the other heating regions 10 may be partially activated. Partial activation of the one or more other heating regions 10 may comprise heating the other heating region(s) 10 to a temperature which is sufficient to substantially prevent condensation of components such as nicotine volatized from the smokable material 5 in the heating chamber 4. An example is 100° C. Other examples include the ranges of partial activation temperatures previously described. The temperature of the heating regions 10 which are partially activated is less than the temperature of the heating region 10 which is fully activated. The smokable material 10 located adjacent the partially activated regions 10 is not heated to a temperature sufficient to volatize components of the smokable material 5. For example, upon full activation of a new heating region 10, the previously fully activated heating region 10 is partially but not fully deactivated so as to continue to heat its adjacent smokable material 5 at a lower temperature and thus prevent condensation of volatized components in the heating chamber 4. Retaining the previous, or any other, heating regions 10 in a partially rather than fully activated state during full activation of one or more other heating regions 10 prevents the smokable material 5 adjacent the fully activated regions 10 from becoming overly toasted and thus avoids potential negative effects on the flavours experienced by the user of the apparatus 1.

For any of the alternatives described above, the heating regions 10 may either be heated to full operational temperature immediately after activation or may initially be heated to a lower temperature, as previously discussed, before being fully activated after a predetermined period of time to heat the smokable material 5 to volatize nicotine and other aromatic compounds.

Figure 17:
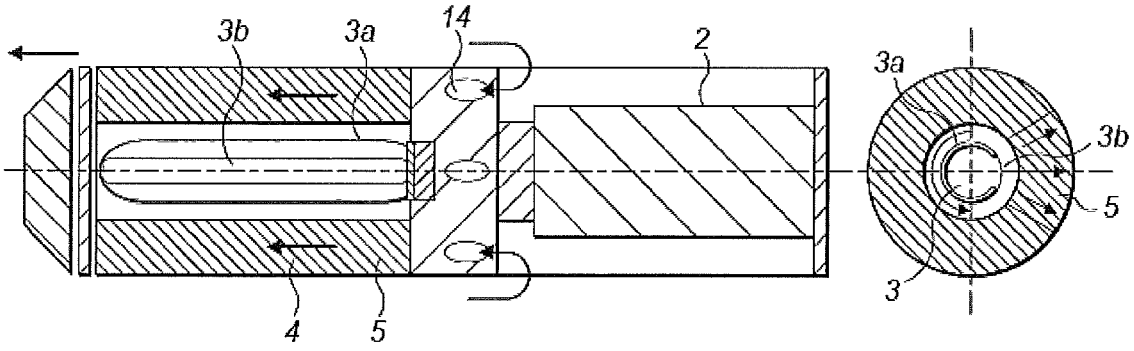
FIG. 17 is a schematic, cross-sectional illustration of a heat shield and a heat-transparent window which are moveable relative to a body of smokable material to selectively allow thermal energy to be transmitted to different sections of the smokable material through the window.

The apparatus 1 may comprise a heat shield 3*a*, which is located between the heater 3 and the heating chamber 4/smokable material 5. The heat shield 3*a* is configured to substantially prevent thermal energy from flowing through the heat shield 3*a* and therefore can be used to selectively prevent the smokable material 5 from being heated even when the heater 3 is activated and emitting thermal energy. Referring to FIG. 17, the heat shield 3*a* may, for example, comprise a cylindrical layer of heat reflective material which is located co-axially around the heater 3. Alternatively, if the heater 3 is located around the heating chamber 4 and smokable material 5 as previously described with reference to FIG. 2, the heat shield 3*a* may comprise a cylindrical layer of heat reflective material which is located co-axially around the heating chamber 4 and co-axially inside of the heater 3. The heat shield 3*a* may additionally or alternatively comprise a heat-insulating layer configured to insulate the heater 3 from the smokable material 5.

The heat shield 3*a* comprises a substantially heat-transparent window 3*b* which allows thermal energy to propagate through the window 3*b* and into the heating chamber 4 and smokable material 5. Therefore, the section of smokable material 5 which is aligned with the window 3*b* is heated whilst the remainder of the smokable material 5 is not. The heat shield 3*a* and window 3*b* may be rotatable or otherwise moveable with respect the smokable material 5 so that different sections of the smokable material 5 can be selectively and individually heated by rotating or moving the heat shield 3*a* and window 3*b*. The effect may be similar to the effect provided by selectively and individually activating the heating regions 10 referred to previously. For example, the heat shield 3*a* and window 3*b* may be rotated or otherwise moved incrementally in response to a signal from the puff detector 13. Additionally or alternatively, the heat shield 3*a* and window 3*b* may be rotated or otherwise moved incrementally in response to a predetermined heating period having elapsed. Movement or rotation of the heat shield 3*a* and window 3*b* may be controlled by electronic signals from the controller 12. The relative rotation or other movement of the heat shield 3*a*/window 3*b* and smokable material 5 may be driven by a stepper motor 3*c* under the control of the controller 12. This is illustrated in FIG. 17. Alternatively, the heat shield 3*a* and window 3*b* may be manually rotated using a user control such as an actuator on the housing 7. The heat shield 3*a* does not need to be cylindrical and may optionally comprise one or more suitably positioned longitudinally extending elements and or/plates.

It will be appreciated that a similar result can be obtained by rotating or moving the smokable material 5 relative to the heater 3, heat shield 3*a* and window 3*b*. For example, the heating chamber 4 may be rotatable around the heater 3. If this is the case, the above description relating to movement of the heat shield 3*a* can be applied instead to movement of the heating chamber 4 relative to the heat shield 3*a*.

The heat shield 3*a* may comprise a coating on the longitudinal surface of the heater 3. In this case, an area of the heater's surface is left uncoated to form the heat-transparent window 3*b*. The heater 3 can be rotated or otherwise moved, for example under the control of the controller 12 or user controls, to cause different sections of the smokable material 5 to be heated. Alternatively, the heat shield 3*a* and window 3*b* may comprise a separate shield 3*a* which is rotatable or otherwise moveable relative to both the heater 3 and the smokable material 5 under the control of the controller 12 or other user controls.

Figure 12:
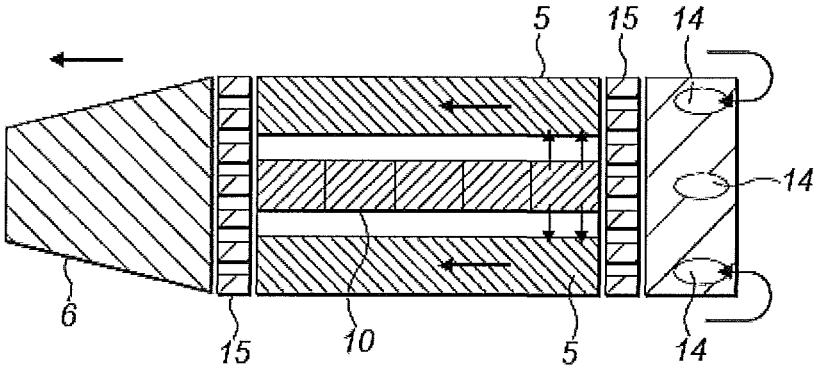
FIG. 12 is a schematic illustration of a gaseous flow through an apparatus configured to heat smokable material.
Figure 18:
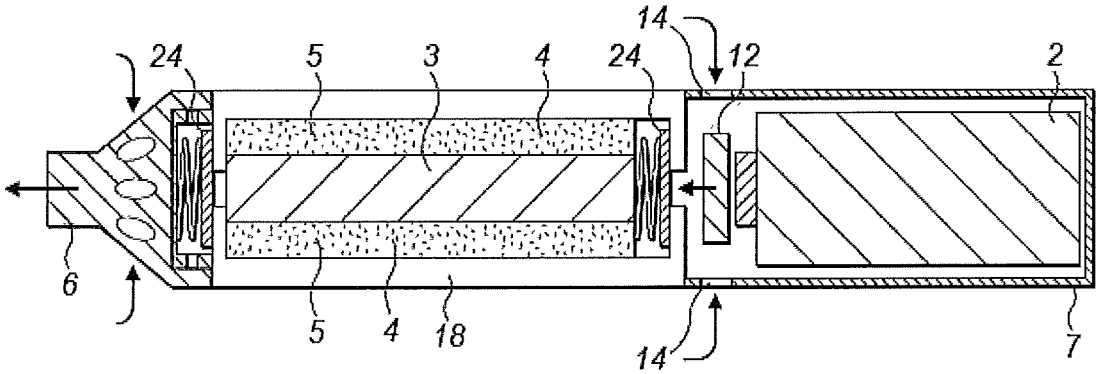
FIG. 18 is schematic, cross sectional illustration of part of an apparatus configured to heat smokable material, in which a heating chamber is hermetically sealable by check valves.

Referring to FIG. 7, the apparatus 1 may comprise air inlets 14 which allow external air to be drawn into the housing 7 and through the heated smokable material 5 during puffing. The air inlets 14 may comprise apertures 14 in the housing 7 and may be located upstream from the smokable material 5 and heating chamber 4 towards the first end 8 of the housing 7. This is shown in FIGS. 2, 12 and 18. Air drawn in through the inlets 14 travels through the heated smokable material 5 and therein is enriched with smokable material vapours, such as aroma vapours, before passing through the outlet valves 24 and being inhaled by the user at the mouthpiece 6. Optionally, as shown in FIG. 12, the apparatus 1 may comprise a heat exchanger 15 configured to warm the air before it enters the smokable material 5 and/or to cool the air before it is drawn through the mouthpiece 6. For example, the heat exchanger 15 may be configured to use heat extracted from the air entering the mouthpiece 6 to warm new air before it enters the smokable material 5.

Referring to FIG. 18, as previously discussed, the heating chamber 4 insulated by the insulation 18 may comprise inlet and outlet valves 24, such as check valves, which hermetically seal the heating chamber 4 when closed. The valves 24 may be one-way valves, where the inlet valve(s) 24 allows gaseous flow into the chamber 4 and the outlet valve(s) 24 allows gaseous flow out of the chamber 4. Gaseous flow in the opposite direction is prevented. The valves 24 can thereby prevent air from undesirably entering and exiting the chamber 4 and can prevent smokable material flavours from exiting the chamber 4. The inlet and outlet valves 24 may, for example, be provided in the insulation 18. Between puffs, the valves 24 may be closed by the controller 12, or other means such as a manually-operable actuator, so that all volatilized substances remain contained inside the chamber 4 in-between puffs. The partial pressure of the volatized substances between puffs reaches the saturated vapour pressure and the amount of evaporated substances therefore depends only on the temperature in the heating chamber 4. This helps to ensure that the delivery of volatilized nicotine and aromatic compounds remains constant from puff to puff.

During puffing, the valves 24 open so that air can flow through the chamber 4 to carry volatilized smokable material components to the mouthpiece 6. Opening of the valves 24 may be caused by the controller 12 or by other means. A membrane can be located in the valves 24 to ensure that no oxygen enters the chamber 4. The valves 24 may be breath-actuated so that the valves 24 open in response to detection of a puff at the mouthpiece 6. The valves 24 may close in response to a detection that a puff has ended. Alternatively, the valves 24 may close following the elapse of a predetermined period after their opening. The predetermined period may be timed by the controller 12. Optionally, a mechanical or other suitable opening/closing means may be present so that the valves 24 open and close automatically. For example, the gaseous movement caused by a user puffing on the mouthpiece 6 may exert a force on the valves 24 to cause them to open and close. Therefore, the use of the controller 12 is not required to actuate the valves 24.

The mass of the smokable material 5 which is heated by the heater 3, for example by each heating region 10, may be in the range of 0.2 to 1.0 g. The temperature to which the smokable material 5 is heated may be user controllable, for example to any temperature within the temperature range of 100° C. to 250° C., such as any temperature within the range of 150° C. to 250° C. and the other volatizing temperature ranges previously described. The mass of the apparatus 1 as a whole may be in the range of 70 to 125 g. A battery 2 with a capacity of 1000 to 3000 mAh and voltage of 3.7V can be used. The heating regions 10 may be configured to individually and selectively heat between approximately 10 and 40 sections of smokable material 5 for a single cartridge 11.

It will be appreciated that any of the alternatives described above can be used singly or in combination.

In order to address various issues and advance the art, the entirety of this disclosure shows by way of illustration various embodiments in which the claimed invention(s) may be practiced and provide for superior apparatuses and methods. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An apparatus, comprising:

a cylindrical, elongate smokable material heater including:

a first heater cylinder configured to heat a first region of a smokable material to a volatizing temperature sufficient to volatize a component of the smokable material, wherein the first region of the smokable material is the smokable material located within the first heater cylinder; and a second heater cylinder configured to heat, concurrently with the first heater cylinder heating the first region of the smokable material, a second region of the smokable material to a temperature lower than said volatizing temperature but sufficient to prevent condensation of volatized components of the smokable material, wherein the second region of the smokable material is the smokable material located within the second heater cylinder, the first heater cylinder and the second heater cylinder being axially aligned, and wherein a combined length of the first heater cylinder and the second heater cylinder is approximately equal to a length of the smokable material.

2. The apparatus according to claim 1, wherein the apparatus is configured to control the temperature of the first region of the smokable material independently of the temperature of the second region of the smokable material.

3. The apparatus according to claim 1, wherein the apparatus comprises a controller configured to cause the first heater cylinder to heat the first region of the smokable material to said volatizing temperature and to cause the second heater cylinder to concurrently heat the second region of the smokable material to said lower temperature.

4. The apparatus according to claim 3, wherein the controller is further configured to subsequently cause the first heater cylinder to heat the first region of the smokable material to said lower temperature and to cause the second heater cylinder to concurrently heat the second region of the smokable material to said volatizing temperature.

5. The apparatus according to claim 1, further configured to successively heat different regions of the smokable material to said volatizing temperature whilst concurrently heating a region of the smokable material not heated to said volatizing temperature to said lower temperature to prevent condensation of volatized components.

6. The apparatus according to claim 1, including a smokable material heat chamber disposed within the cylindrical, elongate smokable material heater, the heat chamber sized to contain the smokable material during heating.

7. The apparatus according to claim 6, wherein the lower temperature prevents condensation of volatized components in the heat chamber.

8. The apparatus according to claim 1, further comprising a mouthpiece through which volatized components of the smokable material can be inhaled during use.

9. The apparatus according to claim 1, wherein the volatizing temperature is at least 100 degrees Celsius.

10. The apparatus according to claim 1, wherein the lower temperature is less than 100 degrees Celsius.

11. The apparatus according to claim 2, further comprising a controller configured to control the temperature of the first heater cylinder independently of the temperature of the second heater cylinder.

12. The apparatus of claim 11, wherein the controller is electronically connected to the cylindrical, elongate smokable material heater.

13. A method of heating smokable material by a cylindrical, elongate smokable material heater, comprising:

heating a first region of a smokable material to a volatizing temperature to volatize at least one component of the smokable material for inhalation, wherein the first region of the smokable material is located within a first heater cylinder; and concurrently heating a second region of the smokable material to a temperature which is lower than the volatizing temperature, but sufficient to prevent condensation of volatized components of the smokable material, wherein the second region of the smokable material is located within a second heater cylinder, wherein the first heater cylinder and the second heater cylinder are axially aligned, and wherein a combined length of the first heater cylinder and the second heater cylinder is approximately equal to a length of the smokable material.

14. The method according to claim 13, wherein the volatizing temperature is at least 100 degrees Celsius.

15. The method according to claim 13, wherein the lower temperature is less than 100 degrees Celsius.

* * * * *